US005666827A

United States Patent [19]

Gunter et al.

[11] Patent Number: 5,666,827

[45] Date of Patent: Sep. 16, 1997

[54] MULTI-STAGE FLUID AND CHEMICAL RECOVERY SYSTEM FOR A TEXTILE ARTICLE COMMERCIAL BLEACHING APPARATUS

[75] Inventors: Jonnie G. Gunter; Grant A. Hurd, both of Pulaski, Va.

[73] Assignee: Renfro Corporation, Mount Airy, N.C.

[21] Appl. No.: 670,398

[22] Filed: Jun. 25, 1996

[51] Int. Cl.[6] ..... D06B 21/02

[52] U.S. Cl. ..... 68/27

[58] Field of Search ..... 68/18 R, 27

[56] References Cited

U.S. PATENT DOCUMENTS 383,869 6/1888 Davies ..... 68/27
453,975 6/1891 De Pawlowski ..... 68/27
3,044,285 7/1962 Koplin ..... 68/27 X
3,653,808 4/1972 Ishizawa et al. ..... 68/27 X

*Primary Examiner*—Philip R. Coe
*Attorney, Agent, or Firm*—Charles Y. Lackey; Kilpatrick Stockton LLP

[57] ABSTRACT

A multi-stage fluid and chemical recovery system for a textile article commercial bleaching apparatus having a plurality of bleaching tanks, a fluid and chemical supply system for providing fluid and chemicals to the bleaching tanks, a recirculation system connected to the bleaching tanks for reclaiming fluids and chemicals from the bleaching tanks after treating quantities if textile articles and for preselectively recycling the reclaimed fluids and chemicals into successive quantities of textile articles in the bleaching tanks. A control system is connected to the fluid supply system and the fluid recirculation system for initiating and controlling the introduction of new fluids and chemicals and reclaimed fluids and chemicals to the bleaching tanks so that each stage of the system operates continuously and/or simultaneously with the other stages.

13 Claims, 1 Drawing Sheet

MULTI-STAGE FLUID AND CHEMICAL RECOVERY SYSTEM FOR A TEXTILE ARTICLE COMMERCIAL BLEACHING APPARATUS

BACKGROUND OF THE INVENTION—FIELD OF THE INVENTION

The present invention relates generally to a commercial apparatus for bleaching quantities of textile articles and, more particularly, to a multi-stage bleach liquor recovery system for continuously reclaiming, storing, and recycling bleach liquor into successive quantities of textile articles in a plurality of bleaching tanks.

BACKGROUND OF THE INVENTION—DESCRIPTION OF THE PRIOR ART

Textile articles such as athletic socks and undergarments are typically bleached prior to their packaging for sale. Such articles, when knit in the greige, have a yellowish-gray appearance instead of the bright white color that consumers seek. Conventional bleaching processes for these types of articles have traditionally utilized a sodium hypochlorite/hydrogen peroxide bleach liquor in either batch or tunnel type bleaching devices. In a batch device, the items are first bleached by washing with a predetermined volume of a conventional bleach liquor and then are subsequently rinsed and softened by appropriate operations. In tunnel devices, a continuous length of the fabric to be bleached is run through an assembly line type apparatus that involves using the same fluid and chemical baths continuously until they are depleted.

A number of U.S. patents disclose various devices for continuously processing lengths of material such as textile articles. See, for example, U.S. Pat. No. 3,518,847 (Continuous Bleaching), U.S. Pat. No. 4,055,971 (Continuous and Waterless Dyeing), U.S. Pat. No. 4,074,969 (Continuous Process for Recycling and Reuse of Gaseous Effluents), U.S. Pat. No. 4,286,394 (Multiple Chamber System for Recovering Residues of Solvent), U.S. Pat. No. 4,418,433 (Method and System for Reusing and Reclaiming Gum and Water), and U.S. Pat. No. 5,232,476 (Solvent Recovery and Reclamation System).

While continuous treating devices like those disclosed in the above-mentioned references save water and chemicals, they are somewhat complicated; expensive to operate and are more likely to malfunction than batch type devices.

There has been improvement in bleaching devices of this nature as evidenced by U.S. patent application Ser. No. 08/540,796 filed Oct. 11, 1995 directed to a Bleach Liquor Recovery System. This development includes a single continuously operating unit wherein chemical and fluid use is supplemented by metered portions of chemicals to recharge each bath, thereby eliminating the waste associated with disposing of each full bath after a bleaching operation and replenishing an entirely new bath in its stead. This development has functioned efficiently; however, its output is limited in volume.

Thus, there remains a need for a new and improved commercial bleaching device that achieves the benefits of saving time, water, chemicals and energy by recovering the used bleach liquor and then reusing the reclaimed bleach liquor in successive loads to obtain greater volumes. It is to this need that the present invention is directed.

SUMMARY AND OBJECTIVES OF THE INVENTION

The present invention is directed to a multi-stage fluid and chemical recovery system for a textile article commercial bleaching apparatus having a plurality of bleaching tanks, a withdrawal and recirculation system connected to the bleaching tanks for preselectively reclaiming the fluid and chemicals form the bleaching tanks after preselectively treating quantities of textile articles and for preselectively recycling the reclaimed fluid and chemicals into successive quantities of textile articles in the bleaching tanks. A control system is connected to the fluid withdrawal and recirculation system for controlling the preselected introduction of new fluids and chemicals and reclaimed fluids and chemicals into the bleaching tanks, thereby forming recovery cycles, the control system operable to cause the continuous and simultaneous operation of a plurality of recovery cycles.

The withdrawal and recirculation system includes a plurality of collection tanks connected to the bleaching tanks for reclaiming fluid and chemicals from selected bleaching tanks after bleaching a quantity of textile articles and for recycling the reclaimed fluid and chemicals back to the bleaching tanks.

The control system also includes control equipment associated with each bleach tank and each collection tank for controlling the introduction of fresh fluid and chemicals and the reclaimed fluid and chemicals into each bleaching tank.

The removal and recirculation system includes a bleach collection tank, a water collection tank, and a softener collection tank, the bleach, water and softener collection tanks being flowably connected to each of the bleaching tanks. The control means also provides for the simultaneous operation of bleaching in a first bleaching tank, rinsing in a second bleaching tank, and softening in the third bleaching tank.

Accordingly, one aspect of the present invention is to provide a multi-stage bleach liquor recovery system for commercial bleaching apparatus that has all of the advantages of prior art devices and more, and none of the disadvantages.

Another objective of the present invention is to provide a multi-stage fluid and chemical recovery system of the type described having three stages, each having a recovery cycle including bleach, rinse and softening steps.

Yet another objective of the present invention is to provide a multi-stage fluid and chemical recovery system of the type described wherein the operations of each cycle of each stage can be staggered and continuous, simultaneous and continuous, or a combination of both with respect to the remaining cycles.

Yet a further objective of the present invention is to provide a multi-stage fluid and chemical recovery system of the type described that can bleach in quantities heretofore unachieveable by prior art systems.

These and other objectives of the present invention will become more apparent to those skilled in the art after a consideration of the following detailed description taken in conjunction with the accompanying drawing, wherein like characters of reference designate like parts.

DESCRIPTION OF THE PREFERRED EMBODIMENT

Figure 1:
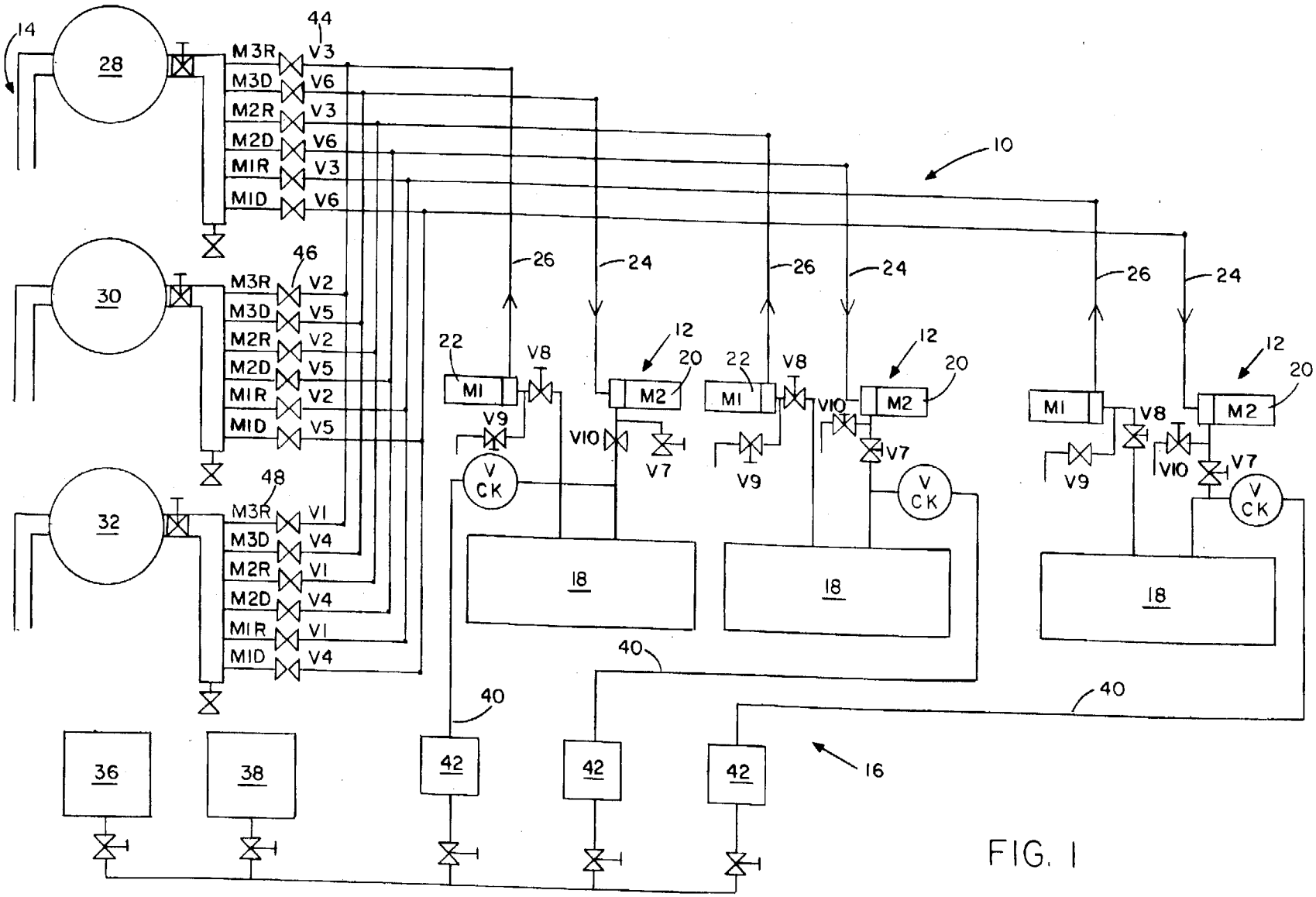
FIG. 1 is schematic representation of a multi-stage bleach liquor recovery system made in accordance with the present invention which shows the flow of fluids and chemicals, new and reclaimed, into and through the system.

The present invention is a multi-stage bleach liquor recovery system for a commercial textile article bleaching apparatus which is operated to continuously use residues of fluids and chemicals by replenishing them at the end of each step of each cycle to speed up the bleaching process and reduce chemical waste and energy loss.

The bleach liquor utilized in the present invention is preferably a conventional aqueous bleach liquor having hydrogen peroxide ($H_2O_2$) and an alkali bleaching agent. It is to be understood, however, that any conventional commercial bleaching agent, as well as any other type of conventional chemical used as a textile fabric treatment, could be used with the apparatus and method of the present invention.

Referring now to FIG. 1, the system comprising the present invention is shown generally as 10 and is made up of three individual stages 12 connected in tandem and served by a common withdrawal and circulation system 14 and a common control system 16.

Each stage 12 includes a bleaching tank 18, an input pump 20 and an emptying pump 22 for selectively filling and emptying bleaching tank 18. Each bleaching tank includes an input conduit 24 and an output conduit 26 which are connected to collection tanks 28, 30 and 32. These tanks are large and capable of holding up to at least 400 gallons of fluid so that one or more of the stages can be operated simultaneously.

Control system 16 for injecting additional mixtures of fluid and chemicals is made up of recharge tanks 36, 38, suitably connected to bleaching tanks 18 by conduits 40. Pumps 42 provide the necessary means to move the needed supplemental mixture of fluid and chemicals to the appropriate bleaching tanks 18.

Each stage 12 has a three step cycle that includes first bleaching, then rinsing, and then softening the treated textile articles. In operation, the bleaching process is commenced by the introduction of a plurality of textile articles into the appropriate bleaching tank where agitation for a sufficient period of time takes place to cause the desired bleaching. When done, the bleach mixture is removed from bleaching tank 18 to bleach holding tank 28 through conduit 26 and line 44.

Bleaching tank 18 is then filled with clear water from tank 30 through conduit 46 and line 24 until a sufficient quantity is injected. Thereafter, rinse takes place, and the rinse water is drained directly from the system.

During the next step, a softener solution is introduced into the system through conduit 48 and line 24. The textile articles are then introduced to the mixture and treated for a sufficient period of time. Once the softening step is completed, the solution is removed from bleaching tank 18 through line 26 and into softener collection tank 32 where it is held until ready for recycling into another bleaching tank. Since the softening agent is depleted during the softening step, additional softening chemicals are usually manually introduced into the bleaching tank 18 when the softening step is about to commence. Tank 18 has been filled with recycled softener solution.

The operation of the system can take place with all three stages operating in unison and exactly at the same time, since holding tanks 28, 30 and 32 are sufficiently large to accommodate the quantity needed. The stages can be staggered in operation whereby the first step in one stage is completed and when the second stage commences, the first step of a second stage is initiated. The operation may continue wherein the first step in the third stage commences at the same time the third step in the first stage is actuated. Any number of combinations can be developed for operational purposes, depending upon the desired output.

The chemical depletion rate can be critically measured by titration to establish the efficiency of the bleach liquor recovery system in recovering hydrogen peroxide and alkali. It has been found, however, that the chemical recovery percentage values are generally constant from load to load. Therefore, the same quantity of chemicals can be added to the reclaimed bleach liquor after each load, greatly simplifying set-up and operation of the system. There is no need to titrate or otherwise moderate the chemical concentrations in the reclaimed bleach liquor after every load. Thus, conventional equipment such as a Durant control unit may be used to program or meter out a predetermined volume of fluid and chemicals.

Moreover, the volume of water needed to replenish the bleach liquor is approximately the same, as is the volume of water needed to replenish the rinse water and the volume of softener needed to replenish the softener. As mentioned earlier, the softener chemical is usually manually added to each recycle softener solution along with an additional amount of water to top off the bleaching tank 18.

Various modifications and improvements will occur to those skilled in the art upon a review of the foregoing description. Further, the technology embodied in the present invention may also be used in applications other than in bleaching systems. For example, washing machines or other types of cleaning systems could employ the technology of the present invention to reclaim and reuse cleaning substances such as wash water. It is to be understood that all such modifications and improvements are understood to be well within the capabilities of those skilled in the art and are properly within the scope of the following claims.

What is claimed is:

1. A multi-stage fluid and chemical recovery system for a textile article commercial bleaching apparatus comprising: a plurality of bleaching tanks; a fluid and chemical supply system for preselectively providing a plurality of fluids and chemicals to the bleaching tanks; a recirculation system connected to the bleaching tanks for preselectively reclaiming the fluids and chemicals from the bleaching tanks after preselectively treating a quantity of textile articles and for preselectively recycling the reclaimed fluids and chemicals into successive pluralities of textile articles in the bleaching tanks; and a control system connected to the fluid supply system and the fluid recirculation system for controlling preselective introduction of new fluids and chemicals and reclaimed fluids and chemicals into the bleaching tanks, thereby forming fluid recovery cycles, the control system operable to cause the continuous and simultaneous operation of more than one recovery cycle.

2. A multi-stage fluid and chemical recovery system for a textile article commercial bleaching apparatus comprising: a plurality of bleaching tanks; a withdrawal and recirculation system connected to the bleaching tanks for preselectively reclaiming the fluid and chemicals from the bleaching tanks after preselectively treating quantities of textile articles and for preselectively recycling the reclaimed fluid and chemicals into successive quantities of textile articles in the bleaching tanks; and a control system connected to the fluid withdrawal and recirculation system for controlling the preselective introduction of new fluids and chemicals and reclaimed fluids and chemicals into the bleaching tanks, thereby forming recovery cycles, the control system operable to cause the continuous and simultaneous operation of more than one recovery cycle.

3. The system as claimed in claim 2 wherein the withdrawal and recirculation system includes a plurality of collection tanks connected to the bleaching tanks for reclaiming fluid and chemicals from bleaching tanks after bleaching a quantity of textile articles and for recycling the reclaimed fluid and chemicals back to the bleaching tanks.

4. The system as claimed in claim 3 wherein the control system includes control means associated with each bleach tank and each collection tank for controlling the introduction of fresh fluid and chemicals and the reclaimed fluid and chemicals into each bleaching tank.

5. The system as claimed in claim 3 wherein the control system includes control means associated with each bleach tank and each collection tank for controlling the introduction of fresh fluid and chemicals and the reclaimed fluid and chemicals into each bleaching tank and wherein the removal and recirculation system includes a bleach collection tank, a water collection tank, and a softener collection tank, the bleach, water and softener collection tanks being flowably connected to each of the bleach collection tanks.

6. The system as claimed in claim 5 wherein the control means provides the simultaneous operation of bleaching in a first bleaching tank, rinsing in a second bleaching tank and softening in the third bleaching tank.

7. The system as claimed in claim 6 wherein the chemicals include a bleach and a softener.

8. The system as claimed in claim 2 wherein the control system includes control means associated with each bleach tank and each collection tank for controlling the introduction of fresh fluid and chemicals and the reclaimed fluid and chemicals into each bleaching tank.

9. The system as claimed in claim 2 wherein the removal and recirculation system includes a bleach collection tank, a water collection tank, and a softener collection tank, the bleach, water and softener collection tanks being flowably connected to each of the bleach collection tanks.

10. The system as claimed in claim 2 wherein the control means provide the simultaneous operation of bleaching in a first bleaching tank, rinsing in a second bleaching tank and softening in a third bleaching tank.

11. The system as claimed in claim 2 wherein the control system includes control means associated with each bleach tank and each collection tank for controlling the introduction of fresh fluid and chemicals and the reclaimed fluid and chemicals into each bleaching tank.

12. The system as claimed in claim 2 wherein the removal and recirculation system includes a bleach collection tank, a water collection tank, and a softener collection tank, the bleach, water and softener collection tanks being flowably connected to each of the bleaching tanks.

13. The system as claimed in claim 2 wherein the chemicals include a bleach and a softener.

* * * * *